United States Patent [19]

Payne

[11] Patent Number: 5,048,697

[45] Date of Patent: Sep. 17, 1991

[54] UNIVERSAL HANGING FILE SYSTEM

[76] Inventor: Myron E. Payne, 413 Amherst Ave., Coraopolis, Pa. 15108

[21] Appl. No.: 309,480

[22] Filed: Feb. 13, 1989

[51] Int. Cl.[5] ..... A47F 7/16

[52] U.S. Cl. ..... 211/45; 229/1.5 R; 402/4; 206/425; 206/610; 211/189

[58] Field of Search ..... 211/189, 46, 162, 45; 493/947; 206/425, 610, 632; 402/4; 312/184; 229/1.5 R

[56] References Cited

U.S. PATENT DOCUMENTS 3,999,663 12/1976 Walter et al. ..... 248/909 X 4,765,490 8/1988 Hanson ..... 211/189 X

*Primary Examiner*—Blair M. Johnson

*Attorney, Agent, or Firm*—H. Jay Spiegel

[57] ABSTRACT

The present invention relates to a universal hanging file system wherein both the frame and the hanging folders may be adjusted as to size, so that the system may be usable to store any desired subject matter. The frame designed to support the hanging files may be adjusted as to width, height and length with the hanging files themselves having a plurality of parallel perforations allowing reduction in size as desirable. The hangers for the file folders may be removed while the file folder is being adjusted in size and may thereafter be re-installed.

3 Claims, 1 Drawing Sheet

UNIVERSAL HANGING FILE SYSTEM

BACKGROUND OF THE INVENTION

The present invention relates to a universal hanging file system. In the prior art, it is known to make components adjustable in size, however, to applicant's knowledge, this concept has never been applied to a hanging file system.

U.S. Pat. No. 2,345,793 to Chapel teaches the concept of an envelope which includes structure including perforations allowing conversion of the envelope into a file folder. U.S. Pat. No. 4,613,157 to Drabish discloses the concept of a greeting card having perforations allowing removal of sections thereof so that the card may be reusable.

Neither of these patents contemplates the problems which are solved via the teachings of the present invention.

SUMMARY OF THE INVENTION

The present invention overcomes the deficiencies in the prior art and provides a new and improved universal hanging file system which is extremely versatile in construction and easy to use. The present invention includes the following interrelated aspects and features:

a) In a first aspect, a frame is provided which may be removably inserted in any file drawer as desired. The frame is made up of four L-shaped angle members which are mutually slidably connected together so that they may be extended or contracted to any desired size. Thus, the length, the width, or both may be easily adjusted. Additionally, each angle member has two mutually slidable halves allowing height adjustment.

b) When it is desired to fix the configuration of the frame at a desired size, set screws are provided to frictionally retain the frame in the desired configuration.

c) The file folders which are designed to be used in conjunction with this adjustable frame include removable hangers and a plurality of parallel perforations allowing the file folders to be easily adjusted as to size. When it is desired to adjust the size of the file folders, one or both of the hangers may be removed, whereupon the file folder is reduced in size at one of the perforations thereof, whereupon one or both of the hangers may be re-installed thereon.

Accordingly, it is a first object of the present invention to provide a universal hanging file system.

It is a further object of the present invention to provide such a file system having an adjustable frame and correspondingly adjustable file folders.

It is yet a further object of the present invention to provide such a system wherein the frame and folders may easily be adjustable to any desired size and configuration.

These and other objects, aspects and features of the present invention will be better understood from the following detailed description of the preferred embodiments when read in conjunction with the appended drawing figures.

SPECIFIC DESCRIPTION OF THE PREFERRED EMBODIMENT

Figure 1:
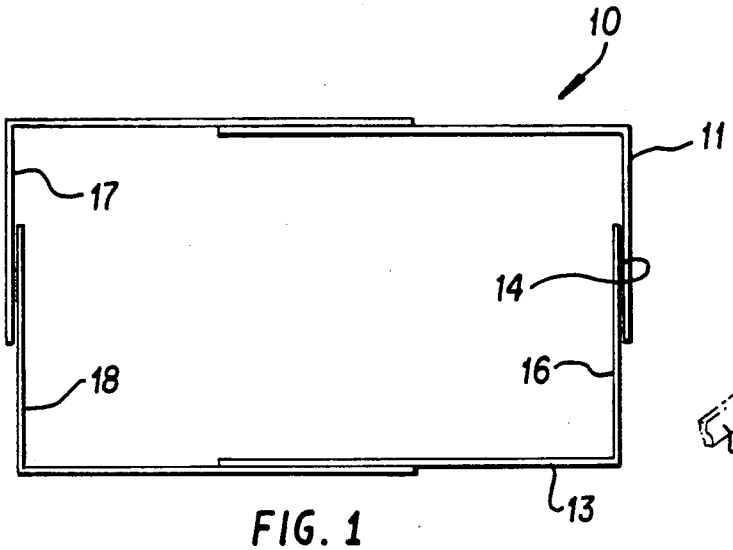
FIG. 1 shows a top view of the inventive frame.

With reference, first, to FIGS. 1–4, the inventive frame is generally designated by the reference numeral 10 and is seen to include L-shaped angle members 11, 13, 15 and 17 as best seen in FIG. 1.

Figure 2:
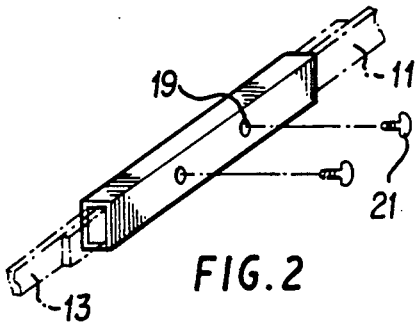
FIG. 2 shows a perspective view of interacting portions of members of the frame.

FIG. 2 shows an adjustment means specifically between the angle members 11 and 13 which consists of a threaded opening 19 in the outer member, in this case the angle member 11, and a thumb screw 21 which may be threaded through the threaded opening 19 so that it may frictionally engage an outer surface 14 of the angle member 13 to thereby comprises a locking means for maintaining a desired orientation of the angle members 11 and 13 with respect to one another of course, the same or similar locking means may be employed for height or vertical adjustment and locking.

Figure 3:
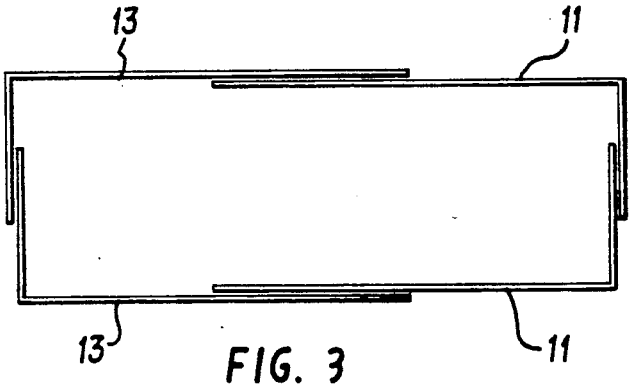
FIG. 3 shows a side view of the inventive frame.
Figure 4:
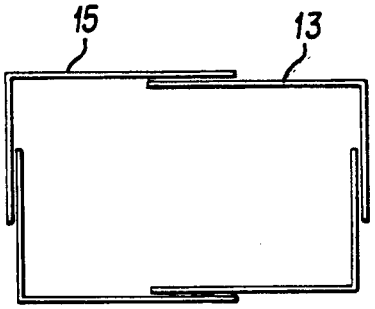
FIG. 4 shows a front view of the inventive frame.

With reference to FIGS. 3 and 4, it should be understood that each of the angle members 11, 13, 15 and 17 is also vertically adjustable by virtue of being made of two slidably assembled halves. Thus, the frame 10 may easily be adjusted as to length, width and height to accommodate to any sized cabinet and any sized document.

Figure 5:
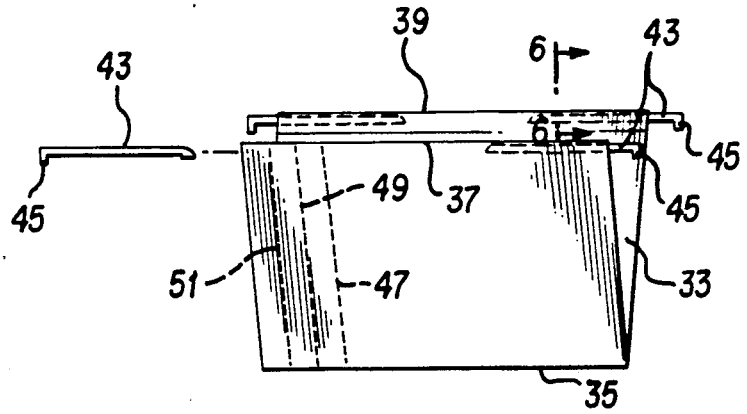
FIG. 5 shows a perspective view of a file folder made in accordance with the teachings of the present invention.
Figure 6:
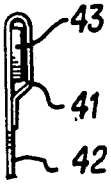
FIG. 6 shows a cross-sectional view along the line 6—6 of FIG. 5.

Further, in this regard, reference is made to FIGS. 5 and 6, wherein the file folder 30 in accordance with the teachings of the present invention is seen to include halves 31 and 33 defined by a central lower seam 35.

Each of the halves 31 and 33 has an upper edge 37 and 39 respectively which includes a looped configuration. With particular reference to FIG. 6, the looped configuration for the half 33 is designated by the reference numeral 41 and is seen to be sized to slidably receive a hanger 43 having a hooked end 45 designed to hang the folder 30 on the edges of the frame 10, for example, the edges 16 and 18 seen in FIG. 1.

In an important aspect of the inventive hanging folder 30, a plurality of rows 47, 49 and 51 of perforations are provided, which rows are mutually parallel. These perforations are provided so that it is possible to easily trim the width of the folder 30 to any desired width. When it is desired to so trim the width of a file folder 30, at least the left-hand hanger 43 in the view of FIG. 5 is removed from the loop 41 whereupon the folder is trimmed at one of the perforation lines 47, 49 or 51 whereupon the hanger 43 may be re-inserted into the loop 41 so that the hanging folder may be hung over the edges 16, 18 of the frame 10. It is noted that the loop 41 is maintained with the end 42 thereof attached to the rest of the folder by any suitable means such as adhesive, tape or the like.

Of course, the perforation lines 47, 49 and 51 are provided at specific locations of the folder 30 so that the folder 30 may be adjusted in size for any desired width such as, legal size, letter size or a size designed to store a floppy disk.

Accordingly, an invention has been described in terms of a preferred embodiment thereof which fulfills each and every one of the objects of the invention as set forth hereinabove. Of course, various changes, modifications and alterations in the teachings of the present invention may be contemplated by those skilled in the art without departing from the intended spirit and scope thereof. As such, it is intended that the present invention only be limited by the terms of the appended claims.

I claim:

1. An improved file folder comprising:

a) a first folder half and a second folder half, said halves meeting at a folder seam;

b) each said half having a looped end distal from said seam, said looped ends extending substantially the entire lateral extent of said halves;

c) each said looped end having mounted therein a hanger at each side thereof;

d) each said half having at least one perforated line spaced from a respective side thereof, said perforated lines being aligned with one another whereby the width of said folder may be adjusted by removing a portion thereof to one side of said perforated lines.

2. The invention of claim 1, wherein each said half has a plurality of perforated lines spaced from one another and respectively lines on each said half.

3. The invention of claim 1, wherein at least those hangers on the side of said folder adjacent said perforated lines are selectively removable from the looped ends of their respective folder halves.

* * * * *